United States Patent [19]

McGill

[11] Patent Number: 4,590,744

[45] Date of Patent: May 27, 1986

[54] PNEUMATIC BOTTLE STOP

[75] Inventor: Robert W. McGill, Munroe Falls, Ohio

[73] Assignee: Figgie International Corporation, Richmond, Va.

[21] Appl. No.: 667,920

[22] Filed: Nov. 2, 1984

[51] Int. Cl.[4] ..... B65B 57/10

[52] U.S. Cl. ..... 53/497; 53/539

[58] Field of Search ..... 53/247, 497, 539, 543; 91/518, 520; 92/8, 143

[56] References Cited

U.S. PATENT DOCUMENTS

| | | | |
|---|---|---|---|
| 3,008,563 | 11/1961 | Carter | 53/497 |
| 3,421,285 | 1/1969 | Barker | 53/497 |
| 4,406,111 | 7/1983 | Raudat | 53/497 |

*Primary Examiner*—James F. Coan

*Attorney, Agent, or Firm*—Oldham, Oldham & Weber Co.

[57] ABSTRACT

A pneumatic bottle stop for a case packer is presented. Fundamentally, the bottle stop consists of a cylinder associated with each lane of a case packer. A piston of each cylinder extends into the lane for making contacting engagement with oncoming bottles or articles. The bottles compress the piston into the cylinder, expelling air therefrom through an adjustable orifice of an associated quick dump valve. The pistons are extended by the application of exhaust air derived from a head control cylinder when the piston of that cylinder is drawn to position skid bars in the head to receive oncoming bottles. A bleeder valve is provided such that the cylinders associated with each lane are maintained at atmospheric pressure after extension of the associated pistons.

19 Claims, 3 Drawing Figures

PNEUMATIC BOTTLE STOP

TECHNICAL FIELD

The invention herein resides in the art of article handling equipment. More particularly, the invention relates to an improvement in a case packer utilized for depositing a full compliment of bottles into an open case. Specifically, the invention is that of a pneumatic bottle stop adapted for absorbing the energy of moving bottles, gradually stopping them at a position immediately above the open case.

BACKGROUND OF THE INVENTION

Numerous types of case packers are presently known in the industry for receiving and depositing a full compliment of bottles in an open case. Such case packers operate at high speeds, receiving a continuous line of oncoming bottles or other articles, and being required to rapidly and reliably fill the cartons with the oncoming bottles of articles. While the invention herein is applicable to the placing of any various articles into a carton, the problems resolved by the invention are particularly unique to bottles. Accordingly, the discussion hereinafter will be with respect to bottles, but it will be understood that any type of article may be intended by that term.

In case packers, bottle stops must be utilized to stop the oncoming stream of bottles such that a full compliment of bottles is maintained in the packing head, immediately above the open case. Heretofore in the art such bottle stops have typically comprised solid blocks, one associated with each lane of oncoming bottles, against which the lead bottle will make contact and immediately stop. Because the bottle stop is rigid, the energy of the oncoming bottle stream must immediately dissipate since the velocity of the bottles immediately drops from some value to zero. In high speed operation, the velocity of the bottles is significant and, accordingly, the kinetic energy of the bottles is correspondingly significant. The result is bottle breakage. To eliminate the bottle breakage, the case packer must be run at a lower speed such that the kinetic energy of the bottles is insufficient to result in bottle breakage. However, a loss of packing efficiency results. Even at low speeds, some bottles have a propensity to break simply because of the geometic configuration of the bottle. Bottles with sharp turns or bends often have a characteristic weak spot which is prone to breakage, requiring further reductions in packing speed. Finally, plastic bottles have a certain degree of resiliency which causes them to bounce off of the bottle stop rather than coming to immediate rest. In such instances, bottles often fall or become misplaced above the empty case.

Regardless of whether the bottles have a tendency to break because of speed or geometric configuration, or whether the bottles have a tendency to bounce because of the material from which they are constructed, it is clear that breakage or bouncing of the oncoming articles results in a reduction of packing efficiency. Reduction in line speed, or stopping of the line to remove broken or fallen bottles defeats the purpose for which automatic packing equipment is designed. To eliminate these problems, applicant has discovered that a bottle stop is required of such a nature as to gradually dissipate the energy of the oncoming bottle stream, rather than instantaneously. However, no such bottle stops have previously been known in the art.

DISCLOSURE OF THE INVENTION

In light of the foregoing, it is a first aspect of the invention to present a pneumatic bottle stop capable of gradually dissipating the energy of the oncoming bottles.

Another aspect of the invention is to provide a pneumatic bottle stop which may be adjusted to accommodate various types of bottles.

Yet another aspect of the invention is the provision of a pneumatic bottle stop which may be adjusted for various line speeds.

Still a further aspect of the invention is the provision of a pneumatic bottle stop which may be readily implemented with presently existing case packing equipment.

An additional aspect of the invention is the provision of a pneumatic bottle stop which will allow case packers to operate at higher speeds with less breakage than previously known.

Still another aspect of the invention is the provision of a pneumatic bottle stop eliminating the bounce characteristic of plastic bottles in a case packing apparatus.

Another aspect of the invention is the provision of a pneumatic bottle stop which is readily incorporated with state of the art equipment, which is durable and reliable in operation, and which is cost effective in implementation.

The foregoing and other aspects of the invention which will become apparent as the detailed description proceeds are achieved by the improvement of an article stop in a case packer having a packing head comprising a plurality of lanes for receiving moving articles therein, a support member in the lanes for supporting the articles, and an actuator connected to the support member in the lanes for selectively shifting the support member and dropping the articles, comprising: reciprocating means associated with each of the lanes for making contacting engagement with the articles being received in the lanes, absorbing and dissipating energy from the moving articles, and stopping the articles.

Other aspects of the invention are achieved by the improvement of a bottle stop assembly in a case packer having a packing head comprising a plurality of lanes for receiving moving articles therein, a support member in each lane for supporting the articles, a head control cylinder having a piston therein operatively connected to the support members, and a source of air pressure connected to the head control cylinder and effecting movement of the piston, comprising: an article stop cylinder having a piston therein associated with each lane, said piston operatively extending into each lane; and a first valve interposed between the source of air pressure, the head control cylinder, and each of said article stop cylinders.

DESCRIPTION OF THE DRAWINGS

For a complete understanding of the objects, techniques and structure of the invention reference should be had to the following detailed description and accompanying drawings wherein.

DETAILED DESCRIPTION OF PREFERRED EMBODIMENT

Figure 1:
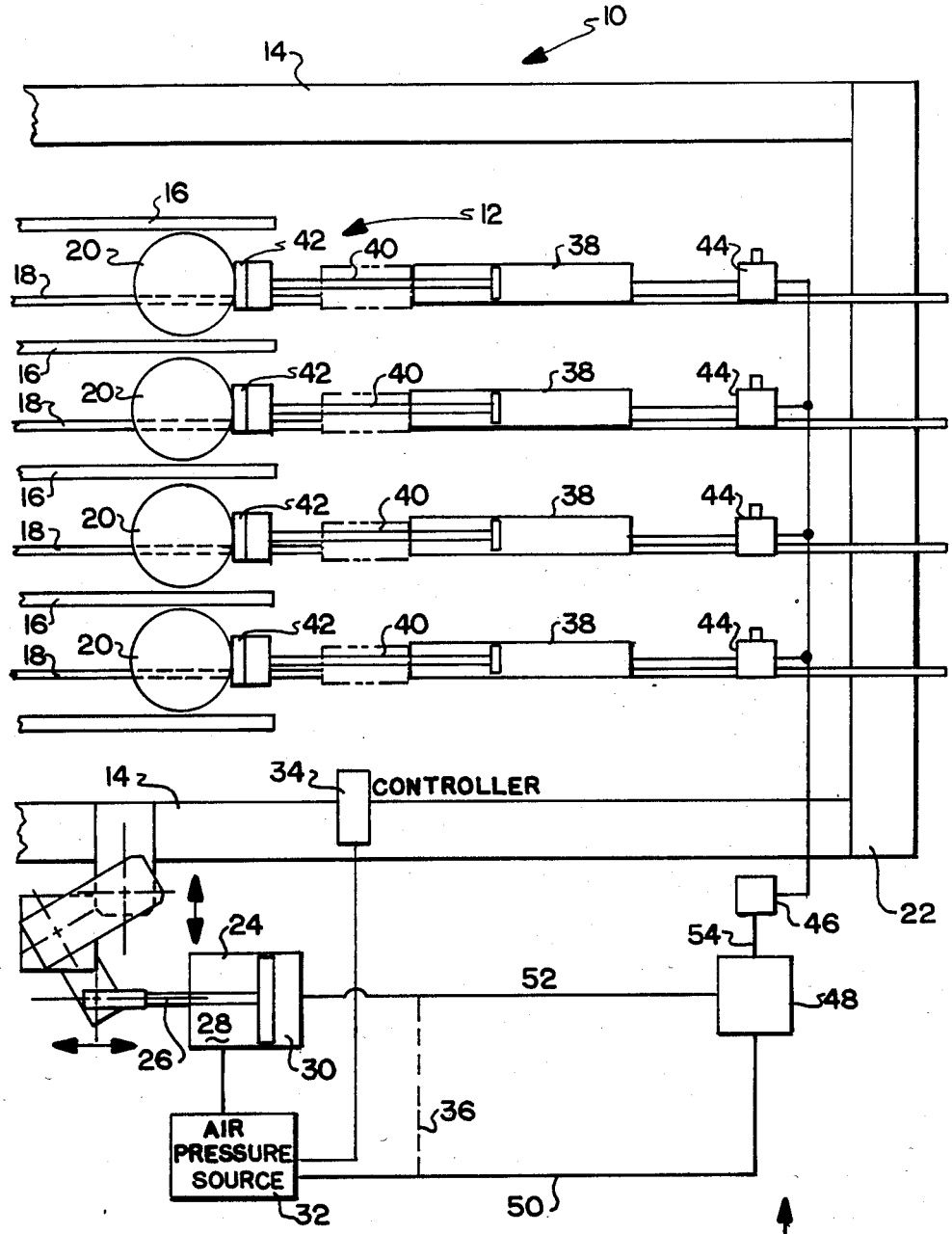
FIG. 1 is a schematic diagram of a case packing head utilizing the structure of the invention.

Referring now to the drawings and more particularly FIG. 1, it can be seen that a pneumatic bottle stop system according to the invention is designated generally by the numeral 10. The system is adapted for use with a case packer head assembly shown in partial cut-away view and designated generally by the numeral 12. As shown, the head assembly 12 includes side plates or rails 14 with lane dividers or guide plates 16 spaced therebetween. In the system shown in FIG. 1, four lanes are formed by the rails 14 and guide plates 16, but it will be understood that any number of such lanes could be so defined. Four such lanes are shown herein for demonstrative purposes only.

Skid bars 18 are centered in each lane to receive bottles 20 thereon. As mentioned earlier herein, the bottles 20 may be of any desired geometric configuration, but are shown as being round in the drawing. Interconnecting each of the skid bars 18 is a rail, bar, or plate 22. While only one is shown, typically the skid bars 18 are interconnected at both the front and back of the packing head. As will be readily appreciated by those skilled in the art, the packing head, and accordingly the skid bars 18, would typically be of a length to receive a fixed number of bottles, such as six each, depending upon the volume of the case to be filled. Since packing heads are well known in the art, the full packing head is not shown, nor is a full compliment of bottles.

An air cylinder 24, actuated in both directions, is provided with a piston 26 operating between and defining the cavities 28,30. The piston 26 connects to the rail 22 and is accordingly operative for laterally shifting the skid bars 18. An air pressure source 32 connects to the cylinder 24 for making selective application of air pressure to the cylinder under control of the controller 34. Those skilled in the art will understand that the controller 34 may include photodetectors or the like for sensing the presence of a full compliment of bottles 20 in the head 12. When the controller 34 determines that such a full compliment is present, it actuates the air pressure source 32 to force air pressure into the cavity 30 behind the piston 26. This air pressure is applied via the pressure line 36 shown in phantom in FIG. 1. The application of pressure causes the piston 26 to extend from the cylinder 24, shifting the skid bars 18 upward as shown in FIG. 1. The skid bars slide from under the bottles 20, allowing the bottles to then drop into an open case maintained on a case lift therebelow. Upon extensions of the piston 26 the controller 34 causes the air pressure source 32 to terminate delivery of air pressure to the cavity 30. After a time delay sufficient to allow the bottles 20 to drop, the controller 34 causes the source 32 to apply air pressure to the cavity 28, retracting the skid bars 18 to the position shown in FIG. 1 for the receipt of a new compliment of bottles. As the piston 26 is forced back into the cylinder 24, the air in the cavity 30 is, in the prior art, exhausted to the atmosphere. The process continues as just described, receiving and packing bottles from a continuous oncoming stream.

The structure described thus far comprises a part of the prior art, being typical of most case packers in the industry. The invention consists of the apparatus and technique described below with respect to the stopping of the oncoming bottles 20.

With continued reference to FIG. 1, it can be seen that a plurality of pneumatic cylinders 38 are positioned, one in association with each lane. Each of the cylinders 38 includes a piston 40 extending therefrom and having a stop 42 on the end thereof. Each of the cylinders 38 communicates through a respective quick dump or shuttle valve 44. Each of the valves 44 includes a vent to the atmosphere for dissipating air from the associated cylinder 38 upon return of the piston 40. Preferably, the vent is adjustable so that the rate of return of the piston 40 may be controlled in accordance with the energy being applied thereto.

A bleeder valve 46 is in series connection with the valves 44 which, with respect to each other, are in parallel interconnection. The bleeder valve 46 vents to the atmosphere such that when the cylinders 38 have their respective pistons 40 at their extended position, the cylinders 38 are bled to the atmosphere and are not pressurized.

A quick dump valve or diverter 48 is connected by the line 50 to the air pressure source 32 and by the line 52 to the cavity 30 of the cylinder 24. The diverter 48 is also connected to the bleeder valve 46 via the line 54 as shown. It will be recognized that in the structure just described the prior art line 36 may be deleted since pressurization of the cavity 30 will now be provided via the line 50, diverter 48, and line 52.

In operation of the system just described, the pistons 40 will begin in an extended position into their respective lanes to receive the oncoming bottles. As the line of bottles enter the lane, they approach the stops 42 on the ends of the pistons 40 at a velocity determined by the line speed of the case packer. As the bottles contact the stops 42, they force the piston 40 back into the cylinder 38. The air from the rearward cavity of the cylinder 38 is vented to atmosphere by means of the vent of the associated quick dump valve 44. When all of the pistons 40 have been forced to a stop position, the controller 34 determines that a full compliment of bottles is present in the packing head 12. The controller 34 then causes the pressure source 32 to force air pressure into the line 50. This pressure applied to the diverter 48 causes the diverter 48 to direct such air pressure into the line 52 and thus into the cavity 30. This extends the piston 26, shifting the skid bars 18, and causing the bottles to drop into the case below. The air pressure from the source 32 to the diverter 48 is then terminated by the controller 34. The absence of pressure in a line 50 causes the diverter 48 to now interconnect the lines 52,54.

After a time delay sufficient to allow the bottles 20 to drop, the controller 34 causes the pressure source 32 to force air pressure into the cavity 28 of the cylinder 24, retracting the piston 26, and forcing air under pressure from the cavity 30 through the line 52 and diverter 48 and into the line 54. This air pressure passes through the bleeder valve 48 and each of the quick dump valves 44 to pressurize the associated cylinders 38. Accordingly, the exhaust air from the cylinder 24 is used to actuate the cylinders 38, extending the respective pistons 40 to position the stops 42 to receive a new set of oncoming bottles 20. The rate at which the pistons 40 extend is determined by setting the bleeder valve 46. For this purpose, the bleeder valve 46 is preferably adjustable. In any event, the bleeder valve 46 assures that after the pistons 40 are extended the cylinders 38 are bled to atmospheric pressure and are not pressurized. Accordingly, the oncoming bottles push the pistons 40 against an unpressurized piston. In the absence of pressure from the diverter 48 to the valves 44, the valves 44 vent the cylinders 38 to atmosphere through an adjustable orifice. Accordingly, as the pistons 40 are forced into the cylinder 38 the rate at which the piston 40 is forced into the cylinder 38 is controlled by the setting of the orifice of the valve 44.

Figure 2:
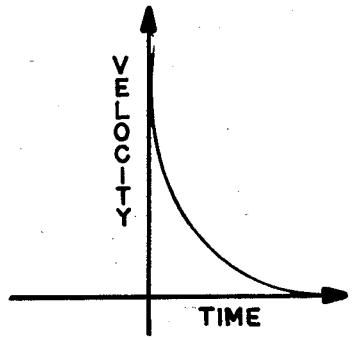
FIG. 2 is a graph demonstrating the stopping of bottles, and accordingly the dissipation of the energy thereof, utilizing the structure of the invention.

FIG. 2 illustrates the stopping of the line of bottles by the cylinder and piston arrangement 38,40. As shown, when the bottles first make contact with the stops 42 they have a velocity determined by the line speed of the packing head. Immediately upon contact of the bottles 20 with the stops 42, the piston 40 begins to move into the cylinder 38, at a rate determined by the kinetic energy of the oncoming bottles 20 and the setting of the orifice of the valve 44. The bottles begin to slow down at a rate characteristic of an exponential decay as shown in FIG. 2. Since the velocity decays exponentially, the energy being adsorbed increases exponentially since the energy of the bottle at any point in time is a function of the velocity squared. It will readily be appreciated that the energy adsorption of the system just described will be low immediately upon contact of the bottles, and then will rapidly rise until the bottle comes to a stop, at which time all energy has been dissipated.

It will further be apparent from FIG. 2 that the orifice of the valves 44 may be adjusted to control the geometry of the curve of FIG. 2, and hence the rate of energy absorption. This adjustment capability allows the system to be tailored to accommodate all sizes and shapes of bottles as well as line speeds.

It should now be readily appreciated that the invention is easily adapted to presently existing case packing systems. Previously, the cavity 30 of the cylinder 24 was simply vented to atmosphere such that, upon the return stroke of the piston 26, the air from the cavity 30 was merely exhausted to the ambient. Removal of the line 36 and replacement thereof with the diverter 48 and the lines 50,52 has allowed use of the exhausted air as a means for operating a pneumatic bottle stop system.

Figure 3:
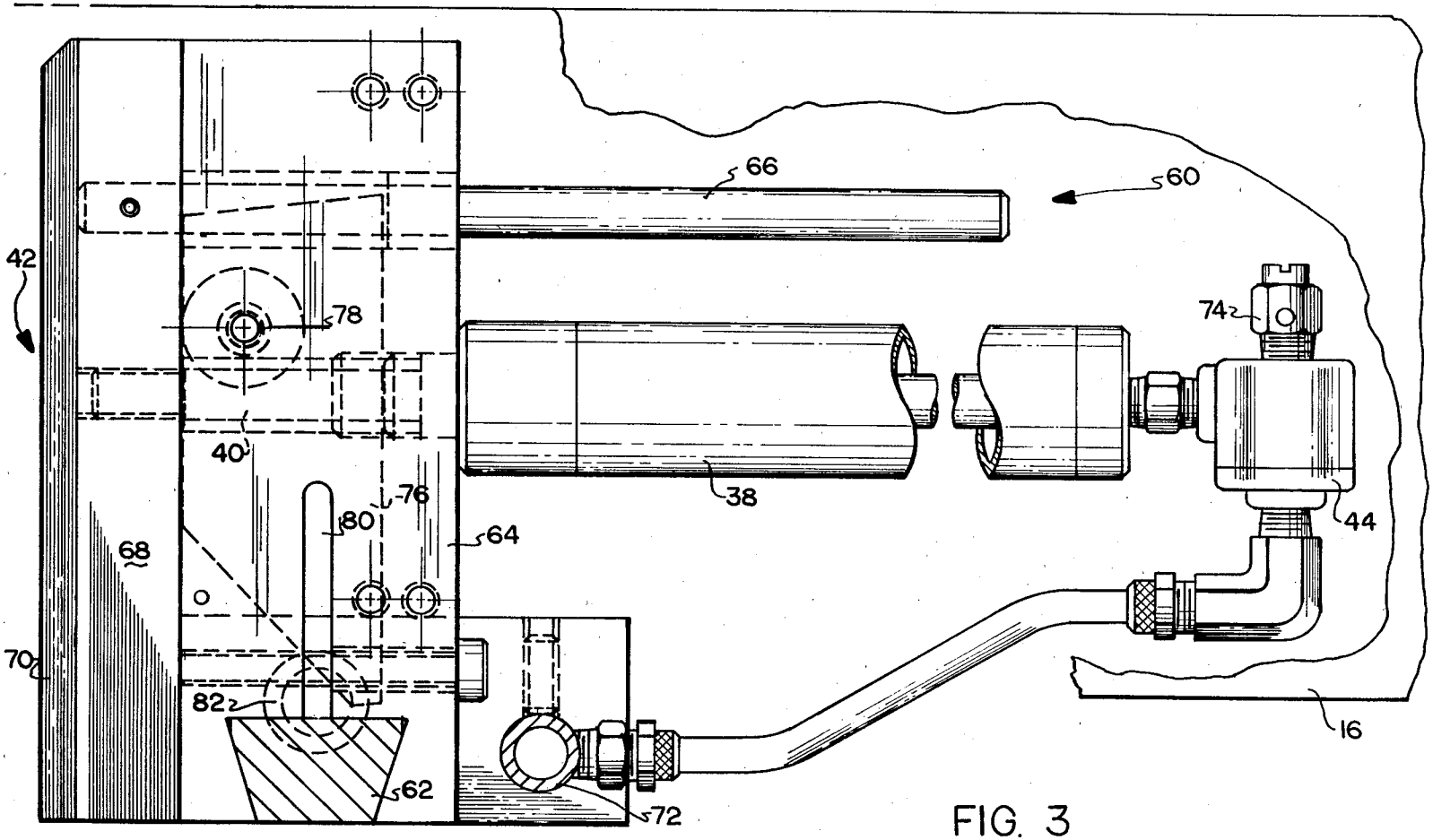
FIG. 3 is a partial sectional view of a pneumatic bottle stop according to the invention.

Referring now to FIG. 3, it can be seen that the piston and stop assembly of the invention is designated generally by the numeral 60. One such assembly is shown in the drawing, while it will be understood that four or six such units would typically be employed in a case packer, depending upon the number of lanes incorporated therein. In any event, a mounting bar 62 is provided for receiving a plurality of stop blocks 64, each suitably housed to receive an associated cylinder 38 and rod of the piston 40. The stop block 64 is also housed to receive a guide rod 66. Both the guide rod 66 and the rod of the piston 40 are secured to a plate 68 having a resilient cushion of foam or rubber 70 attached thereto to further prevent breakage. Housing of the stop block 64 for receipt of the rod of the piston 40 and the guide rod 66 allows for stable lateral movement of the stops 42 comprising the elements 68,70. A manifold pipe 72 connects all the valves 44 to the diverter 48 via the bleeder valve 46.

The adjustable orifice of each of the valves 44 is designated by the numeral 74 as shown in FIG. 3. Again, adjustment of this orifice 74 controls the rate of movement of the piston 40 into the cylinder 38 for any given force or energy application to the stop 42.

With further reference to FIG. 3, it can be seen that each of the lanes has associated therewith a flag 76 pivotally mounted as at 78 to hang by gravity as shown in phantom in the drawing. A slot 80 is provided in each of the stop blocks 64 and is covered by the associated flag 76 when the flag hangs in its normal position by gravity. However, when the bottles 20 have forced the stop 42 into the position shown in the drawing of FIG. 3, the plate 68 makes contact with the flag, pivoting it about the point 78 to expose the bottom of the slot 80. An optical sensor 82 is provided in aligned association with the bottoms of the slots 80 such that, when all the flags 76 have been so actuated, a clear path exists across the bottom of all of the slots 80 of the stop block 64, indicating that a full compliment of bottles is present in the head 12. Typically, the optical sensor 82 would include a light source at one end of the mounting bar 62 and a sensor at the other. Such a flag and optical sensing system has previously been known in the art and is not further elaborated upon herein. Suffice it to say that when all of the pistons 40 have been forced by bottles in their associated lanes into the respective cylinders 38, the flags 76 have been moved by the plates 68 of the stops 42 to such a point that an unobstructed light path exists along the bottoms of the slots 80, indicating to the controller 34 that a full compliment of bottles is present.

Those skilled in the art will recognize that the piston 40 may be selected or adjusted such that, upon extension, the stop 42 is maintained at predetermined point in the associated lane. It will also be understood that adjustment of the orifice 74 will allow the bottles to stop in a predetermined time with a predetermined rate of energy dissipation. It will further be understood that while the rear cavity of the cylinders 38 are connected to the valves 44 and bleeder orifice 74, the front cavity is simply vented to atmosphere.

Thus it can be seen that a unique bottle stop arrangement has been provided which is readily implemented with presently existing case packers, simply capitalizing upon the exhausted air from the packing head cylinder 24. The cushion 70 provides a soft area for receiving the incoming bottles upon initial contact and the controlled exhaust of the cylinder 38 provides for gradual dissipation of energy as the bottles are brought to a stop immediately above the empty case. The rate of energy dissipation may be regulated by means of the adjustable orifice 74 to accommodate any of numerous bottle geometries, masses, or velocities. Bounce and breakage is thus eliminated without sacrificing speed of operation.

Thus it can be seen that the objects of the invention have been satisified by the structure present hereinabove. While in accordance with the patent statutes only the best mode and preferred embodiment of the invention has been presented and described in detail, it will be understood that the invention is not limited thereto or thereby. Accordingly, for an appreciation of the true scope and breadth of the invention reference should be had to the following claims.

What is claimed is:

1. In a case packer having a packing head comprising a plurality of lanes for receiving moving articles therein, a support member in the lanes for supporting the articles, and an actuator connected to the support member in the lanes for selectively shifting the support member and dropping the articles, the improvement of an article stop, comprising:

reciprocating means associated with each of the lanes for making contacting engagement with the articles being received in the lanes, absorbing and dissipating energy from the moving articles, and stopping the articles, said reciprocating means comprising a cylinder having a piston therein, said cylinder connected to a source of pressure; and wherein said source of pressure comprises a first valve connected to the actuator, selectively receiving air under pressure therefrom and directing said air under pressure to said cylinder and extending said piston to a first position.

2. The improvement as recited in claim 1 wherein said reciprocating means further stops the articles within a fixed distance after said making contacting engagement.

3. The improvement as recited in claim 1 wherein said reciprocating means further stops the articles within a fixed time after said making contacting engagement.

4. The improvement as recited in claim 1 wherein said piston has a stop member connected to an end thereof.

5. The improvement as recited in claim 4 wherein said stop member includes a resilient material positioned for contacting engagement with the articles received in the lanes.

6. The improvement as recited in claim 4 which further includes a flag in selective communication with a sensor, said flag being movable by contacting engagement with said stop member into communication with said sensor.

7. The improvement as recited in claim 1 which further includes a second valve interposed between said first valve and said cylinder, said second valve venting said cylinder to the atmosphere upon said piston reaching said first position.

8. The improvement as recited in claim 7 which further includes a third valve interposed between said first valve and said cylinder, said third valve passing said air under pressure from said first valve to said cylinder to extend said piston to said first position and venting air from said cylinder upon movement of said piston to a second position.

9. The improvement as recited in claim 8 wherein said third valve is interposed between said second valve and said cylinder, and wherein said third valve vents said air from said cylinder to the atmosphere.

10. The improvement as recited in claim 8 wherein said second valve is adjustable to control the rate of movement of said piston to said first position.

11. The improvement as recited in claim 8 wherein said third valve is adjustable to control the rate of movement of said piston to said second position.

12. In a case packer having a packing head comprising a plurality of lanes for receiving articles therein, a support member in each lane for supporting the articles, a head control cylinder having a piston therein operatively connected to the support members, and a source of air pressure connected to the head control cylinder and effecting movement of the piston, the improvement of a bottle stop assembly, comprising:

an article stop cylinder having a piston therein associated with each lane, said piston operatively extending into each lane; and a first valve interposed between the source of air pressure, the head control cylinder, and each of said article stop cylinders, said first valve selectively directing air pressure from the air source to the head control cylinder and from the head control cylinder to each said article stop cylinder.

13. The improvement as recited in claim 12 which further includes a plurality of second valves, one interposed between each of said article stop cylinders and said first valve.

14. The improvement as recited in claim 13 wherein said second valves include a venting orifice, said second valves passing air pressure from said first valve to said article stop cylinders in a first direction and venting air from said cylinders through said venting orifice in a second direction.

15. The improvement as recited in claim 14 which further includes a third valve interposed between said first and second valves, said third valve bleeding said article stop cylinders to atmosphere after extension of said piston of said article stop cylinders to a first position in said first direction.

16. The improvement as recited in claim 15 wherein said third valve is adjustable.

17. The improvement as recited in claim 15 wherein each said piston of each said article stop cylinder has a resilient pad attached to an end thereof for contact with the articles.

18. The improvement as recited in claim 17 wherein each lane has a flag associated therewith, each flag being in selective communication with a sensor, and each flag being in selective activated engagement with said piston of an associated article stop cylinder.

19. The improvement as recited in claim 14 wherein said venting orifice is adjustable.

* * * * *